United States Patent [19]

Gore

[11] 3,939,942

[45] Feb. 24, 1976

[54] ELECTROACOUSTIC TRANSDUCERS

[76] Inventor: David E. Gore, 900 N. Broadway, Suite 725, Santa Ana, Calif. 92701

[22] Filed: Apr. 22, 1974

[21] Appl. No.: 462,608

[52] U.S. Cl. ..... 181/157; 181/161; 181/167; 181/173

[51] Int. Cl.[2] ..... G10K 13/00; H04R 7/00

[58] Field of Search ..... 181/157, 167, 173, 160, 181/161, 169, 170, 148

[56] References Cited

UNITED STATES PATENTS

| | | | |
|---|---|---|---|
| 337,753 | 3/1886 | Dowling | 181/167 |
| 1,862,552 | 6/1932 | Schlenker | 181/173 |
| 3,272,281 | 9/1966 | Rutter | 181/157 |
| 3,310,131 | 3/1967 | Ward | 181/157 |

*Primary Examiner*—Stephen J. Tomsky

[57] ABSTRACT

The present invention comprises a radially pulsating cylindrical surface operating as a wave transmission-line. The device is responsive to electrical means and may be practically utilized to generate pressure waves. A conventional electromagnetic driving system is employed with the novel cylindrical surface. A cylindrical voice coil is affixed to the cylindrical surface coaxially. The surface may comprise a matrix of helically oriented fibers suspended in an elastomeric impregnant. Damping means may be provided both internally and terminally. The radiation produced is omnidirectional.

15 Claims, 6 Drawing Figures

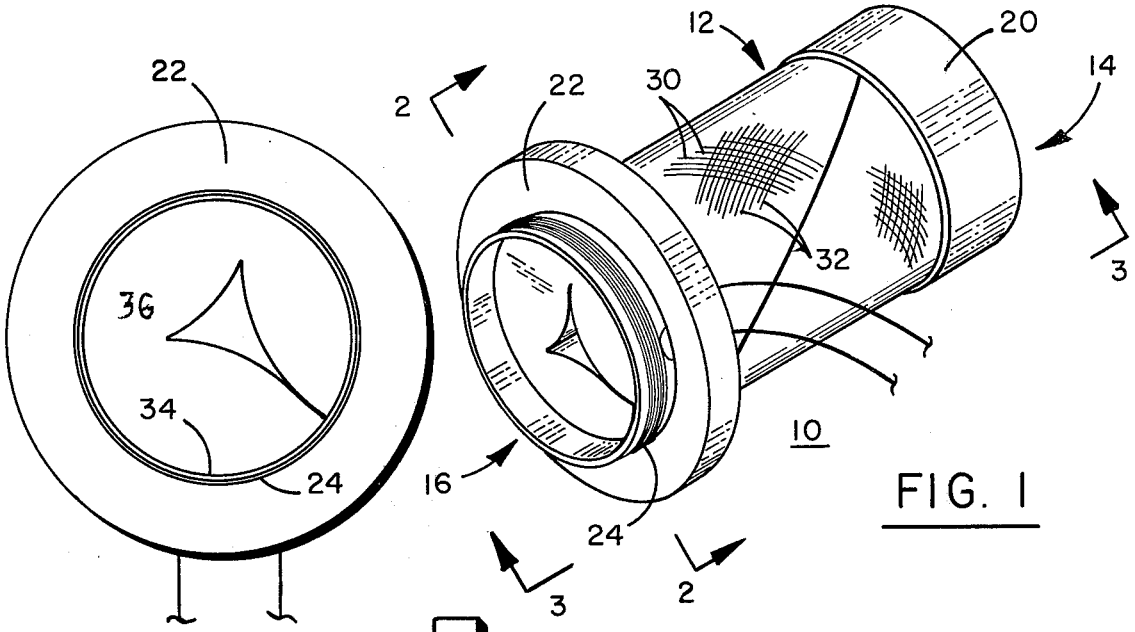
FIG. 1
FIG. 2
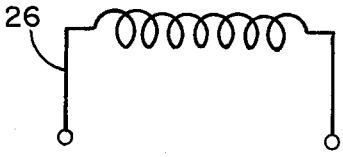
FIG. 6
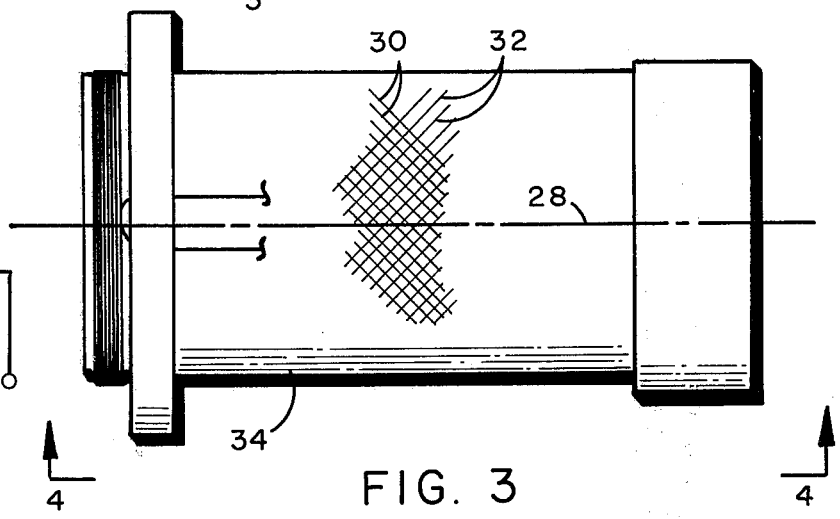
FIG. 3
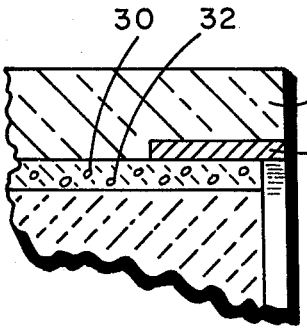
FIG. 5
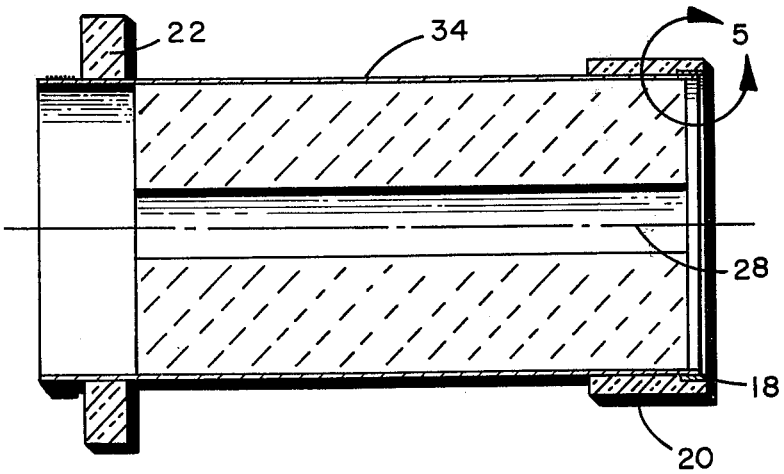
FIG. 4

ELECTROACOUSTIC TRANSDUCERS

BACKGROUND OF THE INVENTION

1. Field of the Invention

The present invention relates to electro-acoustic transducers.

2. Description of the Prior Art

An accurate mechanoacoustic process requires that pressure waves be generated by an orderly motion of a membrane in the medium. When the medium is so displaced a pressure wave is generated. An orderly transformation thus requires that the membrane possess no preferred oscillatory modes. Two primary engineering solutions to this problem have evolved. The more direct solution utilizes a conductive membrane. Both a conductor with a substantially even distribution of electron flow and a voltage controlled electrostatic conductive membrane are moved by direct imposition of electrical forces. Without considering inevitable but controllable boundary conditions due to the support means for such elements, these elements acted upon substantially only by the medium and electrical drive forces cannot exhibit resonant mode of behavior. There are no compliances to act in concert with existing masses. Extensive structures are generally required to supply the required fields. Relatively high cost and complexity result. Structures for producing the field also interfere with radiation. Partially conductive diaphragms substantially immersed in a magnetic field allow decreased size but do not eliminate the other disadvantages.

The prior art also includes a second attempted engineering solution which utilizes a mechanical system of mass and compliance which exhibits an infinite number of oscillatory modes. Such a device is termed a transmission line. A uniform transmission line terminated resistively in the characteristic impedance with a surface in contact with the medium may also generate a pressure wave. Within practial limits set by the degree of uniformity achieved in the construction of the line and terminating impedance, orderly behavior may be achieved.

A basic distinction between these major systems is that a finite time delay is involved before a transmission line achieves steady state power transfer to the medium. A wave-train progressing along the line is increasingly brought into contact with the medium. The process is complete when the termination is reached. The medium however is also a transmission line due substantially to its uniformity.

There exists in the medium a region in which the distance to various portions of the mechanical transmission line is increasingly greater for portions closer to the sending end. At a particular angle in this region the arrival time for a pressure wave originating from the portions of the transmission line is identical. At this angle, the membrane appears to be moving in unison. Practical transmission line transducers involve obtaining a high propagation velocity while also obtaining an efficient match between driving impedance and characteristic impedence.

A pulsating cylinder provides a radiated power which decreases about 6 decibels per octave with a flat response on axis. This is superior to a flat vibrating diaphragm whose radiated power falls about 12 decibels per octave of increasing frequency. Passive diaphragms which are not characterized by transmission line behavior have resonant modes of finite Q which color the reproductive process with frequency dependent characteristics. These characteristics also deteriorate the transient behavior. Any passive mechanical member can substantially meet the definition of a transmission line requiring only that the member be uniform. Each successive incremental segment orthogonal to the axis of propagation must be substantially identical. Exceptions to this rule must have a constant characteristic impedance or frequency selective behavior will occur.

The prior art for transmission line devices discloses only relatively non-uniform constructions. Cone constructions are examples of non-uniform transmission lines. The radius of curvature of these surfaces decreases toward the large end. The propagation velocity varies as well as the characteristic impedence. Difficulty in resolving any characteristic impedence and therefore obtaining reflectionless behavior is to be expected. Operation over small axial lengths of cone reduces the problem but also reduces efficiency. A gradual resistive absorption of the progressing wave also reduces the reflective behavior at the expense of efficiency. The construction is non-uniform but it is good compromise where full-range operation is desired. A further complication occurs because the driving force of a cone is directed at an angle to the plane of the conic surface. This causes a radially symmetrical tortional stress in the cone resisted by the reactive force of the hoop or circumferential compliance. If the cone is slightly irregular or the driving force directed so as not to be radially symmetrical a distortion is propagated as a direct result. This increases tolerance requirements or results in distortions.

Certain of the disadvantages of the prior art have been partially mitigated by substitution of a soft dome arrangement for the cone arrangement described herein in detail. The dome arrangement is limited to high frequency and does not have the frequency range of the cone arrangement. Within this limitation, the dome arrangement has two advantages: the dome is more compact and less expensive.

Unfortunately, the dome arrangement is not a uniform transmission line nor does it have radial dispersion.

SUMMARY OF THE INVENTION

The present invention comprises a radially pulsating cylindrical surface operating as a wave transmission line. For best results, the cylinder is thin and elastic. During operation, the surface of the cylinder is deformed.

During operation, a mechanical driving force is directed substantially evenly on a circumference and is directed axially. A radially symmetric wave is propagated down the cylinder and causes a change in axial length and a corresponding change in radius.

The surface provides efficient radiation for either short wave or long wave length signals. Mechanical vibrations in the surface are absorbed at the terminating end by a plug or surrounding surface of resistive material. Felt, butyl rubber or plastic foam are examples of such suitable materials. The present invention permits a low cost surface to provide a high uniform propagation velocity. The direction of the driving forces is along the cylindrical axis. The motion of the cylindrical surface which displaces the medium, however, is orthogonal to the driving axis. The invention is not merely a diaphragm, but is in fact an elastically controlled leverage system which converts axial tension or compression into radial increases or decreases, respectively.

The leverage process of the present invention is directed by a double counter-roving helical fiber construction. The construction serves to polarize propagation into a radially symmetrical axially propagating disturbance. The compliance of the cylinder allows essentially grain-oriented transmission line operation. Dimensional anomalies in the construction such that the construction deviates from a perfectly cylindrical form do not cause a substantial reduction in performance. Minor unevenness in the applied driving force also has a limited deleterious effect on performance.

Break up modes of vibration involving poorly defined motions not radially symmetrical are strongly inhibited.

A first example of the invention permitting economical construction comprises a square weave textile such as fiberglass cloth with an open weave impregnated with an elastomer and subsequently formed into a cylinder. The bias plies of the cloth are, accordingly, oriented axially and circumferentially. The textile impregnant construction provides a high compliance lowdensity construction. The propagation velocity of a typical construction is 3 times the speed of sound in air. Oriented graphite fiber offers potentially very efficient high performance embodiments.

Compound constructions according to the present invention have the ability to vary the design parameters of propagation velocity and length without affecting the characteristic impedance which is a great advantage. The ability permits the implementation of practical devices capable of both flat frequency/pressure and flat frequency/power responses to the highest audible frequencies. A smoothly varying construction capable of synthesizing an ideal pulsating hemisphere is within the realm of possibility. The well defined low frequency behavior of diaphgram type devices can be complemented by the present invention to provide more nearly ideal performance over the entire audible range. For the first time a reasonably simple and widely dispersed high frequency transducer whose behavior is as predictable and idealized as the low frequency behavior of a diaphragm is available. Complex and costly curved arrays would be required to approach the quality of performance of the present invention. No high frequency transducer known to the prior art is comparable to the present invention is transient response, bandwidth and dispersion at a given cost.

A first end of the cylindrical surface can be made capable of propagating the wave. The surface can comprise an elastically controlled leverage system capable of converting axial tension into radial increases and axial compression into radial decreases.

For most purposes, the cylindrical surface should be capable of becoming essentially grain-oriented during operation. The surface may comprise a square weave textile or a fiberglass cloth with an open-weave impregnated with an elastomer. The bias plies of the cloth may be oriented axially and circumferentially and the surface may comprise a high modulus low-density construction. The surface may comprise an oriented graphite fiber textile with cross-polymerized impregnants. The stiffness to density ratio of the surface may be greater than fiberglass. The surface may comprise a highly compliant subsonic construction capable of producing long wave lengths.

DESCRIPTION OF THE DRAWINGS

Reference should be made at this time to the following detailed description which should be read in conjunction with the following drawings, of which:

FIG. 1 is a three-quarter view of an example of the invention;

FIG. 2 is an end view of the invention along the line 2—2 of FIG. 1;

FIG. 3 is a side view of the invention along the line 3—3 of FIG. 1;

FIG. 4 is a partially cut-away side view of the invention along the line 4—4 of FIG. 3;

FIG. 5 is a more detailed cut-away view of a portion of the invention along the line 5—5 of FIG. 4; and FIG. 6 is an electrical representation of the wire 24 of FIG. 1.

DETAILED DESCRIPTION

Reference should be made at this time to FIG. 1 which illustrates a wave transmission line 10 comprising a radially pulsating cylindrical surface 12. The surface 12 is thin and elastic. During operation, the surface 12 is deformed.

The surface 12 comprises a propagating end 16 and an absorbing end 14. The ends 14, 16, of the surface 12 are open.

Coupling means 18 may be used to hold the ends 14, 16, of the surface 12 together. A cylindrical plug coaxial to the surface 12 and having essentially the same diameter is coupled to the end 14. The plug 20 is fabricated from a resistive material. Felt, butyl rubber or plastic foam are examples of suitable resistive materials for use in the plug. The interior diameter of the plug 20 is approximately the same diameter as the cylindrical surface 12 and is coupled thereto.

During operation, a mechanical driving force is directed substantially evenly on a circumference of the surface 12 and is directed axially from the end 16 to the end 14. A circumferential wave is propagated down the cylinder 12 and causes a change in axial length and a corresponding change in radius of the cylinder 12.

A sponge 22 may be coupled near the end 16 to protect wires 24. The wires 24 are insulated and are coupled to a source of an alternating audio signal.

The wires 24 are firmly affixed by prior art means such as adhesive fastener or a voice coil former near the end 16 in a helical arrangement of the same interior diameter as the exterior diameter of the surface 12. The surface 12 provides efficient radiation for short wave length signals which are thus radiated into a substantially resistive medium. Mechanical vibrations in the surface 12 are absorbed at the end 14 by the plug 20. The present invention permits a low cost surface 12 to provide a high uniform propagation velocity. The direction of the driving forces generated by the wires 24 is along the cylindrical axis 28. The motion of the cylindrical surface 12 which displaces the medium, however, is orthogonal to the driving axis. The invention 10 is not merely a diaphragm, but is in fact an elastically controlled leverage system which converts axial tension or compression into radial increases or decreases, respectively.

Reference should be made at this time FIGS. 2–6, illustrating other views of the invention. The leverage process of the invention 10 is directed by a double counter-roving helical fiber construction. The construction serves to polarize propagation into a radially symmetrical axially propagating disturbance. The cylindrical becomes essentially grainoriented during operation. Dimensional anomalies in the construction such that the construction of the cylindrical surface 12 deviates from a perfectly cylindrical form do not cause a great reduction in performance. Uneveness in the applied driving force also has a minor effect on performance.

Break up modes of vibration involving poorly defined motions not radially symmetrical are strongly inhibited.

A first example of the invention permitting economical construction comprises a square wave textile such as fiberglass cloth 34 with an open weave impregnated with an elastomer (not illustrated by number) and subsequently formed into a cylinder 12. The bias plies 30, 32 of the cloth 34 are, accordingly, oriented axially and circumferentially. The textile impregnant construction provides a high/compliance low-density construction for the surface 12.

The propagation velocity of a typical construction of the surface 12 is three times the speed of sound in air. Another example of the invention comprises graphite fiber textile with cross-polymerized impregnants and exceeds fiberglass in stiffness to density ratio and results in high efficiency. An alternative example utilizing a highly compliant subsonic construction such as neoprine rubber sheet adhesively bonded to aluminum wire screen. which can produce long wavelengths is also possible. Still another example of the invention comprises a cylinder 12 (not shown) having a plurality of adjacent sections. The section closest to the end 16 is hardest and subsequent sections are succeedingly softer. This construction increases the frequency range and tends to shape the emerging wave front. Accordingly, the wave slows as it goes down the cylinder. Each of the sections of the adjoining surface has substantially the same diameter.

In each example of the invention, the alternating audio signal from the signal source (not shown) is coupled to the surface 12 by the wire 24, which is coupled to the surface 12 in a helix and is also coupled in an electrical connection to the alternating audio signal source. The wire 24 initiates the propagation of the radially symmetric wave down the cylindrical surface 12.

For most purposes, the coupling means 18 should be a viscous material which is capable of forming part of the termination means at the end 14. At the end 16, the coupling means may be an adhesive capable of holding the coil wire together.

The plug 20 may have substantially the same diameter as the surface 12 and be coupled to the end thereto, or alternatively may be coupled to the interior of the cylindrical surface 12 and may have an exterior diameter substantially the same as the interior diameter of the cylindrical surface 12.

A magnet structure (not shown, but well-known to the prior art) is required to energize the voice coil.

Other examples of the invention may substitute for the sponge 22 a flex coupling which aligns the cylindrical surface 12 to a structure which supports and retains the magnet. The structure is not shown in the drawings, but is well known to the prior art. Alternate materials which may be substituted for the sponge 22 include elastisized cloth, silicone rubber and other axially compliant support means.

To prevent destruction of the characteristics of the invention, axially compliant support means (not shown) may also be used to support and reinforce the end 14. The support means at the end 14 may include damping means. The plug 20 may be replaced by support means performing the same functions as the plug 20.

The wires 24 may also have a diameter essentially the same as the diameter of the cylinder 12 and may be coupled to the end 16 thereof. Alternatively, the wires 24 may have an exterior diameter essentially identical to the interior diameter of the cylindrical surface 12 and may be coupled thereto.

Both the plug 20, or the equivalent thereof, and the wires 24 may be coupled to the ends 14, 16, of the cylindrical surface 12 by a butt joint if they have a diameter identical to the diameter of the cylindrical surface 12.

There is no necessary interrelationship between the diameters of the wires 24 and plug 20, so that one may have an identical, greater, or lesser diameter than the cylindrical surface 12 without affecting the requirements for the diameter of the other except as set forth herein previously.

While the ends 14, 16, have been shown as open in the drawings, they may be closed.

The invention is not merely a diaphragm but an elastically controlled leverage system which converts axial tension or compression into radial decreases or increases of the cylindrical surface 12 respectively.

This leverage process is directed by a double counterroving helical fiber construction. This construction serves to polarize waves into radially symmetrical axially propagating disturbances. The cylinder is essentially grain-oriented. Compared to an amorphous device, dimensional anomalies in the construction or any unevenness in the applied driving force has a greatly reduced deleterious effect. Non-radially symmetrical break-up modes of vibration are strongly inhibited. A preferred economical construction consists simply of a square weave textile such as fiberglass or aluminum wire with an open weave impregnated with an elastomer and subsequently formed into a cylinder. The bias plies 30, 32 of the cloth are thus oriented axially and circumferentially. This construction provides a high compliance low density assembly. The propagation velocity of a construction may vary from a fraction to many times the speed of sound in air. High velocity devices are best suited for high frequency radiation and low velocity devices for low frequencies. The surface of the cylinder may be seen to consist of a matrix of elastic windows framed by the filament. The sheet compliance of the elastomer is much greater than that of the filament. These filaments therefore pivot on each other with a scissors-like action. These windows are generally parallelograms and altogether form the leverage system referred to above.

The behavior of the cylinder can be defined quantitatively in terms of the linear elastic behavior of a thin sheet. The partial derivitive of a hypothetical surface, X wide by Y high is for small distortions given by:

$$\frac{dX}{X} = -\frac{dY}{Y} \qquad \text{eq. 1}$$

When such a surface is formed into a cylinder and subsequently subjected to constant compressive or tensile forces, a reactive cylinder forms. This reactive cylinder differs in height, radius and volume with respect to the original cylinder. The volume of the cylinder V prior to deformation in terms of the surface X, Y is given by:

$$V = (X/2\pi)\,Y \qquad 2$$

$Y$ is now the axial length and $X/2$ is the radius. The reactive cylinder differs from this undeformed cylinder as defined by the following relationship obtained by taking the partial derivitive of equation 2 with respect to dX and dY:

$$\frac{dV}{dX\,dY} = 1/2\,\pi\,(2YXdX + X^2dY) \qquad \text{eq. 3}$$

Substituting equation 1 into equation 3 to obtain this solution in terms of dY only, we have:

$$\frac{dV}{dX\,dY} = 1/2\,\pi\,(-X^2)\,dY \qquad \text{eq. 4}$$

Turning our attention again to eq. 1 except now expressing X in terms of the radius R and simplifying we have:

$$dR = (-R/Y)dY \qquad 5$$

Equation 1 states that the change in the dimensions of a deformed elastic sheet is proportional to those same dimensions. Under dynamic operation conditions the forces applied are not constant. A sealed cylinder may radiate long waves into an inductive medium according to equation 4.

For the case of short wave operation the medium may be substantially resistive and the acoustic output will be given by equation 5. Both the change in radius and therefore the high frequency displacement and the change in volume are inversely related to the change in height dY. Thus, long and short wave operation in the proper phase relationship is obtained. Medium wavelength behavior is smooth also.

There is an optimal choice of helical fiber angle in the surface which reinforces the sheet elastic behavior given by equation 1. This angle is 45° and is obtainable with a low cost square weave textile construction. Other helical angles result in elastic windows which are not equi-angular at rest. The sheet behavior of this type of fiber controlled elastic surface will consist of basically unequal changes in the dimensions even though they are initially equal. This violates equation 1. Eq. 1 is the partial differential statement of a premise: $XY =$ Constant. The surface area of an elastic sheet remains constant despite small deformation along one axis. The following equations show how the fiber embedment enforces this behavior. Consider a single elastic window of an area A with corner half-angles of $\alpha$ and $90°-\alpha$ in a textile with the same number of fibers per unit length in both directions. The spacing between fibers is D. The area A is then:

$$A = 2D^2 \sin\alpha\cos\alpha \qquad 6$$

The behavior of this area with respect to changes in and equated to 0 provides the equation whose solution is the angle for which any composite surface area of textile is constant for small changes in X and Y as inferred by equation 1:

$$dAd\alpha = 2D^2\,(\cos^2\alpha - \sin^2\alpha) \qquad 7$$

$$dA/d\alpha = 0 \qquad 8$$

$$\alpha = 45° \qquad 9$$

This is fairly obvious by inspection.

The sinusiodal dynamic behavior of a particle in the elastic cylinder varies with actuating frequency. At low frequencies power is transmitted largely to the mechanical load. Negligible acoustic output occurs. Elastic distortions are relatively small and the constituent particles of the cylinder move nearly in unison axially. As the frequency is increased, elastic distortions become appreciable and particle motion becomes elliptical. The major axis of the ellipse is axial and the minor axis is radially oriented. This radial motion occurs 360° around the cylinder and has a causative relationship to the acoustic output.

At high frequency, this motion is circular and is guided by the 45° helical fibers. The power transmitted mechanically down the cylinder is related to the characteristic impedance thereof. The kinetic form of this power is an oscillatory mass flow at a certain velocity. Constant power is transmitted at all frequencies by a wave-train whose amplitude decreases with increasing frequency. The energy delivered to the load is thus constant. A viscous load dissipates the same amount of heat for all frequencies. Some of the power is radiated into the medium. The efficiency depends on the characteristic impedance of the cylinder and its acoustic impedance in the medium. The characteristic impedance $Z_o$ is defined as follows:

$$Z_o = \text{mass} \cdot \text{stiffness} \qquad \text{eq. 10}$$

Where the mass and stiffness are the per unit length values. Many combinations of mass and stiffness in the construction material may thus provide the same characteristic impedance. The propagation velocity u is altered according to the following relationship:

$$u = 1/\ \text{mass/stiffness} \qquad \text{eq. 11}$$

The transit time $t$ of a length of cylinder is simply:

$$t = \text{length}/u \qquad 12$$

For transit time for multi-section arrays of different materials is the sum of the transit times of the sections. subsonic embodiments must be kept short compared to a wavelength of radiated sound in the medium to prevent destructive interference in the vicinity of the surface. Interferences near the surface of supersonic embodiments takes the form of diffraction. Again, this appears in any case where the length of the cylinder compares to a wavelength of sound in the medium or is considerably greater than a wavelength. The diffraction angle $\phi$ is given by:

$$\phi = \cos^{-1}\,[u_{medium}/u_{cylinder}] \qquad 13.$$

An exactly sonic cylinder generates a plane wave propagating axially. The acoustic output is similar to that generated by a flat membrane with radius closely related to the length of the cylinder. Short broadly forward radiating high frequency loudspeakers can be so fabricated. Compound constructions with matched characteristic impedances in each section permit nearly curved virtual vibrating membranes to be substantially acoustically formed. These compound assemblies offer superior broadband performance. The length of successive sections should be inversely related to the propagation velocity of that section. Nearly equal dispersion at all grequencies may be obtained by proper staggering of these parameters. Sections should be bonded with impregnant in a butt joint to provide a reflectionless interconnection. Overlaps modify the characteristic impedance in the overlap region. A three section multi-length compound array radiates nearly flat power over three octaves. The section to section velocity ratio is about 2/1. The axis of diffraction of the sections is approximately 15°, 45°, and 90°. This embodiment has been modeled and is generally preferred for general application as a tweeter in a two-way system.

Lower velocity sections provide better low frequency performance in a given space than high velocity sections of the same characteristic impedance. The low corner frequency is approximately:

$$f_c = 1/2t \qquad 14$$

Where t is the total transit time. Above $f_c$ radiated power begins to fall to a rate of 6db. per octave. Below $f_c$ radiated power falls at −12 db. per octave. The axial frequency pressure response of supersonic embodiments is characteristically flat. Flat frequency response on axis over many octaves may be obtained from a single section even though the power output is falling at 6 db. per octave over much of this range.

A textile-impregnant construction material may be formed into a cylinder with a fiber-oriented helical lap seam. This seam is substantially transparent to the propagated waves and co-acts with the fibers 30, 32, to provide the desired function. Low cost mass production is thus easily achieved. Acoustically absorbent means 36 should be provided inside the cylinder to dissipate unused acoustic energy rapidly. Fiberglass wool and urethane foam are examples of absorbent materials.

A first end of the cylindrical surface can be made capable of propagating the wave. The surface can comprise an elastically controlled leverage system capable of converting axial tension into radial increases and axial compression into radial decreases.

For most purposes, the cylindrical surface should be capable of becoming essentially grain-oriented during operation. The surface may comprise a square weave textile or a fiberglass cloth with an open-weave impregnated with an elastomer. The bias plies of the cloth may be oriented axially and circumferentially and the surface may comprise a high modulus low-density construction.

The surface may comprise an oriented graphite fiber textile with cross-polymerized impregnants. The stiffness to density ratio of the surface may be greater than fiberglass. The lower the modulus of elasticity, and the higher the density, the slower the speed of sound through a material. A particular example of the invention has been described herein. Other examples will be obvious to those skilled in the art. The invention is limited only by the following claims:

I claim:

1. A wave transmission line comprising a cylindrical having a radially pulsating thin surface; and a mechanical driving force directed on a circumference of the cylinder in an axial direction to deform the surface of the cylinder.

2. The invention of claim 1 further including a first end of said cylindrical surface propagating a wave which wave, in turn, causes a change in axial length and a corresponding change in radius of said cylindar; and a second end of said cylindrical surface comprising a plug of resistive material terminating said wave.

3. The invention of claim 2 where the resistive material of the plug is felt.

4. The invention of claim 2 where the resistive material of the plug is butyl rubber.

5. The invention of claim 2 where the resistive material of the plug is plastic foam.

6. The invention of claim 1 wherein the surface comprises an elastically controlled leverage system converting axial tension into radical decreases and axial compression into radial increases.

7. The invention of claim 1 wherein the surface comprises a double counter-roving helical fiber construction.

8. The invention of claim 7 wherein the cylindrical surface becomes essentially grain-oriented during operation.

9. The invention of claim 1 wherein the surface comprises a square weave textile.

10. The invention of claim 9 wherein the surface comprises a fiberglass cloth with an open-weave impregnated with an elastomer.

11. The invention of claim 10 wherein the bias plies of the cloth are oriented axially and circumferentially and wherein the surface comprises a high modulus low-density construction.

12. The invention of claim 11 wherein the surface has a propagation velocity of 3 times the speed of sound in air.

13. The invention of claim 1 wherein the surface comprises an oriented graphite fiber textile with cross-polymerized impregnants.

14. The invention of claim 13 wherein the stiffness to density ratio of the surface is greater than fiberglass.

15. The invention of claim 1 wherein the mechanical driving force is transmitted substantially evenly on a circumference in an axial direction.

* * * * *